US005565736A

United States Patent [19]

Friederichs

[11] Patent Number: 5,565,736

[45] Date of Patent: Oct. 15, 1996

[54] DISCHARGE LAMP PROVIDED WITH A BIMETAL SWITCH, AND BIMETAL SWITCH SUITABLE FOR A LAMP

[75] Inventor: Winand H. A. M. Friederichs, Eindhoven, Netherlands

[73] Assignee: U.S. Philips Corporation, New York, N.Y.

[21] Appl. No.: 336,960

[22] Filed: Nov. 10, 1994

[30] Foreign Application Priority Data

Nov. 12, 1993 [BE] Belgium ..... 09301253

[51] Int. Cl.[6] ..... H01J 7/44

[52] U.S. Cl. ..... 315/47; 315/73; 315/74; 315/106; 315/362

[58] Field of Search ..... 315/47, 74, 106, 315/73, 362

[56] References Cited

U.S. PATENT DOCUMENTS

| | | | |
|---|---|---|---|
| 4,329,621 | 5/1982 | Barakitis | 315/47 |
| 4,981,330 | 1/1991 | Van Delm et al. | 315/47 |
| 5,079,480 | 1/1992 | Canale et al. | 315/47 |

*Primary Examiner*—Frank Gonzalez
*Assistant Examiner*—Reginald A. Ratliff
*Attorney, Agent, or Firm*—Brian J. Wieghaus

[57] ABSTRACT

A high-pressure discharge lamp includes a discharge vessel which is enclosed with intervening space by an outer bulb. The lamp is provided with a starter circuit constructed as a starter unit comprising a bimetal switch and glow switch starter. The bimetal switch has a bimetal element which is fastened with a fastening point to a conductor, and rests in the cold state against a break contact point of a break contact. The fastening point and the break contact point form part of an insulating rigid body.

8 Claims, 2 Drawing Sheets

DISCHARGE LAMP PROVIDED WITH A BIMETAL SWITCH, AND BIMETAL SWITCH SUITABLE FOR A LAMP

BACKGROUND OF THE INVENTION

The invention relates to a high-pressure discharge lamp provided with a discharge vessel which is enclosed with intervening space by an outer bulb and is provided with a starter circuit comprising at least a bimetal switch with a bimetal element, which element is fastened with a fastening point to a conductor and rests against a break contact point of a break contact of the bimetal switch in the cold state.

The invention also relates to a bimetal switch suitable for use in a starter circuit of a discharge lamp and to a starter unit provided with such a bimetal switch.

A lamp of the kind mentioned in the opening paragraph is known from EP-A-0 345 873, which corresponds to U.S. Pat. No. 4,981,330.

In the known lamp, the fastening point of the bimetal element is fastened to an electrical supply conductor extending to a lamp electrode.

The contact point of the break contact is formed by a conductor which is wound around the discharge vessel so as to form a wire winding, which conductor is connected to a further electrical supply conductor via a glowswitch starter.

Although the construction as a wire winding around the discharge vessel provides a good definition of the contact point of the break contact, it is found in practice that fastening of the bimetal element to the supply conductor often leads to problems. For example a small tangential displacement of the fastening point of the bimetal element on the supply conductor will already have a major influence on the position of the bimetal element relative to the contact point of the break contact. This may easily give rise to an incorrect functioning, or a failure to function altogether, of the bimetal switch. An incorrect adjustment of the bimetal element thus created can only be corrected in a separate aftertreatment during the lamp production process by means of a readjustment of the mechanical pretensioning of the bimetal element. The said displacement leads to production rejects in those cases in which no repair is found to be possible.

The invention has for its object to provide a means by which the above disadvantages can be counteracted.

SUMMARY OF THE INVENTION

According to the invention, a lamp is for this purpose characterized in that the bimetal switch comprises an insulating rigid body with an electrical connection conductor at either end, and in that the fastening point and the break contact point form part of said insulating rigid body.

Since both fastening point and contact point form part of one and the same rigid body, their mutual placements are well defined. A further advantage is that the bimetal switch is composed of only two parts, in contrast to the state of the art, and forms an independent element which may be prefabricated separately from lamp manufacture and may be subsequently mounted. The bimetal switch according to the invention also provides the advantage of an excellent permanence of shape.

An elongate ceramic support provided on either side with a metal, preferably nickel cap, each cap with a connection conductor, is particularly suitable for forming the rigid insulating body. Such insulating bodies are known, inter alia, as supports for resistance wire.

Nickel is suitable for the metal cap and connection conductor for electrical connection inter alia because it does not or substantially does not oxidize and has good soldering and welding properties. This is favourable for achieving an electrical connection. Other suitable metals are, for example, Mo, Ta, W and iron alloys.

In the prior-art lamp, the starter circuit is also provided with a glowswitch starter. This is placed between two electrical supply conductors to electrodes in the discharge vessel and is electrically connected thereto. Such an arrangement is favourable per se for realising an efficient lamp manufacturing process.

In a further improvement of a lamp according to the invention, whose starter circuit is also provided with a glowswitch starter, the bimetal switch and the glowswitch starter are assembled into a separate unit which is arranged between current supply conductors. A further improvement in the efficiency of the lamp manufacturing process can be realised thereby, the number of separate components required during this process being minimized. It also renders possible a further mechanization of the lamp manufacturing process.

A starter unit according to the invention is preferably formed by a glowswitch starter with a longitudinal axis and a bimetal switch, which bimetal switch comprises an insulating rigid body with an electrical connection conductor at either end, and which bimetal switch has a long axis, while both an electrically conducting fastening point for fastening a bimetal element and an electrically conducting break contact point for forming a break contact in conjunction with the bimetal element form part of the insulating rigid body. This renders possible a robust construction of the starter unit. In an advantageous embodiment of the starter unit, the insulating rigid body is positioned with its long axis parallel to the longitudinal axis and adjacent the housing of the glowswitch starter, which leads to a compact construction of the starter unit. A compact construction is conducive to tile robustness and permanence of shape. In a further advantageous embodiment, the starter unit is provided with connection conductors which are situated diametrically opposite one another in relation to the longitudinal axis of the glowswitch starter, tangent to the housing, and parallel to one another in a plane perpendicular to the longitudinal axis of the glowswitch starter. As a result, the starter unit can be readily mounted in a lamp, for example, between current supply conductors inside tile lamp.

BRIEF DESCRIPTION OF THE DRAWINGS

The above and further aspects of the invention will be explained in more detail with reference to a drawing in which.

DETAILED DESCRIPTION OF THE PREFERRED EMBODIMENTS

Figure 1:
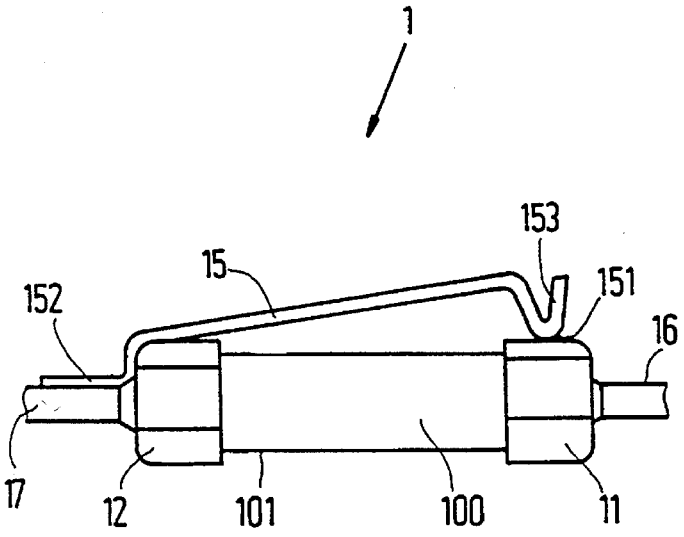
FIG. 1 shows a bimetal switch i according to the invention.

FIG. 1 shows a bimetal switch according to the invention which is suitable inter alia for use in a starter circuit of a discharge lamp. The switch comprises an insulating rigid body with an electrical connection conductor at either end. The insulating rigid body comprises a ceramic support 100 with a surface 101 which is provided with a metal, in particular a nickel cap 11, 12 at either end. A conductor 16 issues from nickel cap 11 and a conductor 17 from nickel cap 12. The conductors 16 and 17 forming the electrical connection conductors at either end, form part of the insulating rigid body, and serve or electrical connection in the starter circuit.

The bimetal switch 1 is provided with a bimetal element 15.

The nickel cap 12 forms a fastening point at 152 for the bimetal element 15 to the electrical conductor 17 where this conductor issues from this cap. The portion of nickel cap 11 present on the surface 101 forms a break contact at 151 of the bimetal switch against which the bimetal switch 15 rests in the cold state. Preferably, the bimetal element is provided with a profile 153 where it rests against the contact point 151. This promotes a well-defined contact between bimetal element and contact point 151. The embodiment shown is advantageous in those cases in which the nickel cap 12 has a polygonal circumference. In an alternative embodiment, the fastening point 152 is situated on the portion of the nickel cap 12 which lies on the surface 101. This embodiment may be advantageously used inter alia when the nickel cap has a circular or rectangular circumference.

Figure 2:
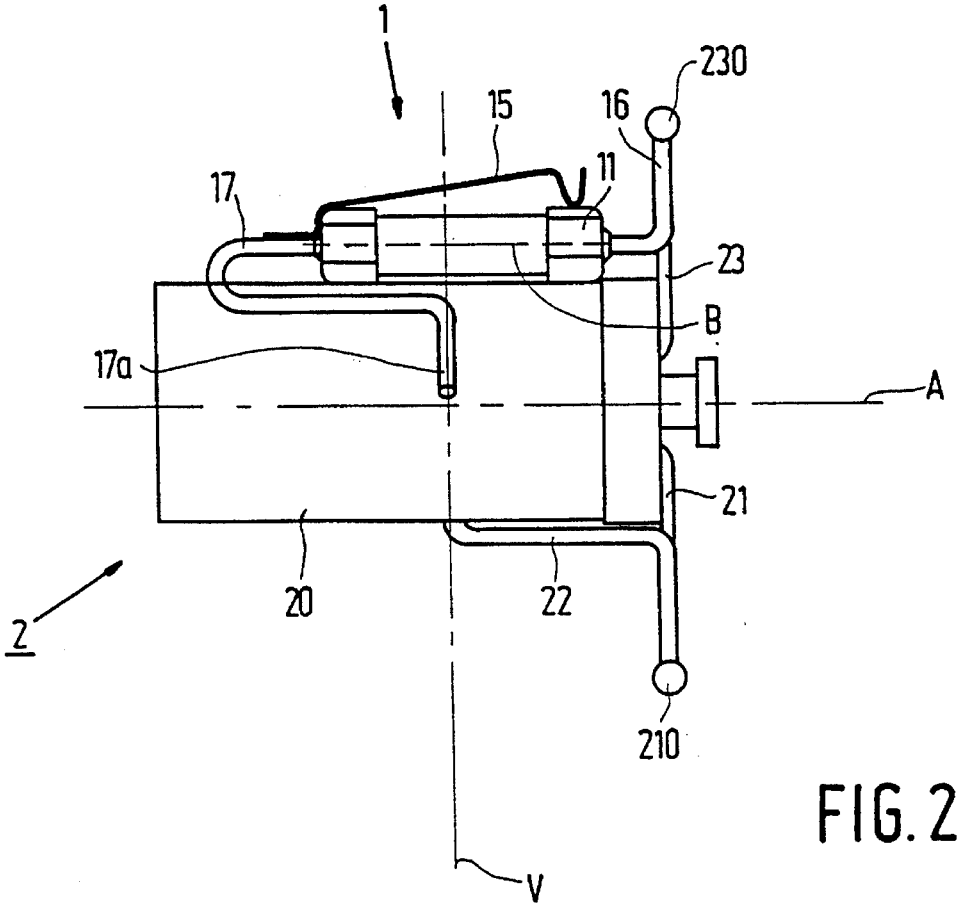
FIG. 2 shows a combination of a glowswitch starter and a bimetal switch assembled into a separate unit.

In FIG. 2, the bimetal switch according to FIG. 1 has been assembled together with a glowswitch starter 2 into a separate starter unit. Parts corresponding to those in FIG. 1 have been given the same reference numerals.

The glowswitch starter 2, provided with an elongate glass housing with a longitudinal axis A, is fitted with two connection conductors 21, 23 in a manner known per se. Connection conductor 23 is bent so as to extend transversely to the longitudinal axis A and is electrically connected to conductor 16 of bimetal switch 1 by means of a welded joint 230 at its end. The conductor 16 is also extended away for this purpose and positioned partly transversely to the longitudinal axis A. The ceramic support 100 of the bimetal switch 1 is positioned with a long axis B parallel to longitudinal axis A adjacent the housing of the glowswitch starter. Conductor 17 of bimetal switch 1 is bent back and guided parallel to the longitudinal axis along the surface of the glass housing 20 to adjacent a plane V perpendicular to the longitudinal axis A and extending at the centre of longitudinal axis A. An end portion 17*a* of conductor 17 is situated in said plane V and tangent to the glass housing. In a manner similar to that of conductor 23, connection conductor 21 of glowswitch starter 2 is extended and positioned partly transversely to longitudinal axis A. Conductor 21 is electrically connected to a conductor 22 by means of a welded joint 210, an end of the latter conductor being situated in plane V, tangent to the glass housing 20, diametrically opposite and extending parallel to conductor 17*a*. The conductors 22 and 17*a* serve as connection conductors for connecting the starter unit to supply conductors inside the lamp. This is further illustrated in FIGS. 3 and 4.

The welded joints 210 and 230 are formed by means of arc fusion (TIG welding). This is desirable because the conductors 21 and 23 have usually become strongly oxidized during glowswitch starter production. The conductors 21 and 23 in the embodiment described are made of Ni—Fe wire. The manufacture of a butt weld by resistance welding under such circumstances does not lead to a reliable joint and is therefore not suitable. The use of clamping bushes is found in practice, but it is cumbersome and less reliable than a well-formed welded joint.

The starter unit described has a very compact construction. This is favourable for mounting of the starter unit in the lamp. In addition, a compact construction is desired in view of a high robustness and satisfactory permanence of shape of the starter unit which in itself is necessary for an efficient mechanized mounting of the starter unit as part of a modern and efficient lamp manufacture.

Figure 3:
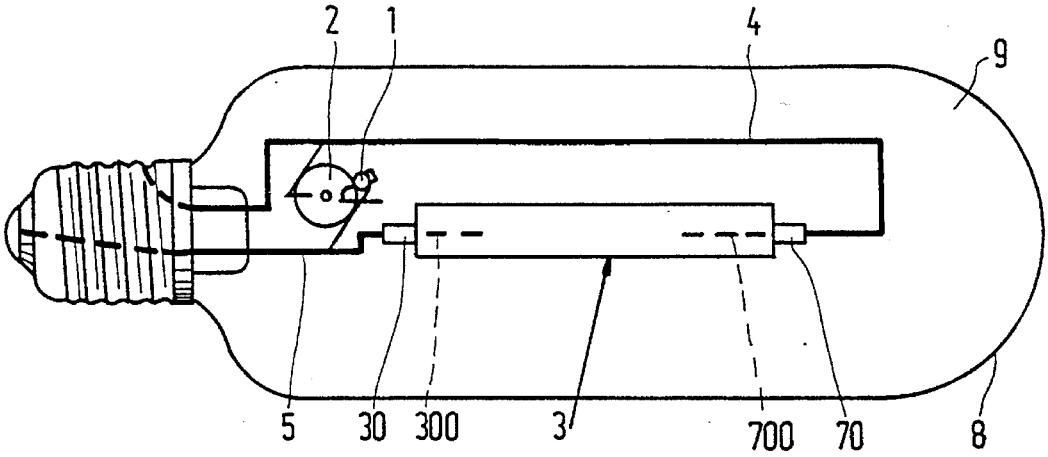
FIG. 3 shows a lamp according to the invention provided with a bimetal switch according to the invention.
Figure 4:
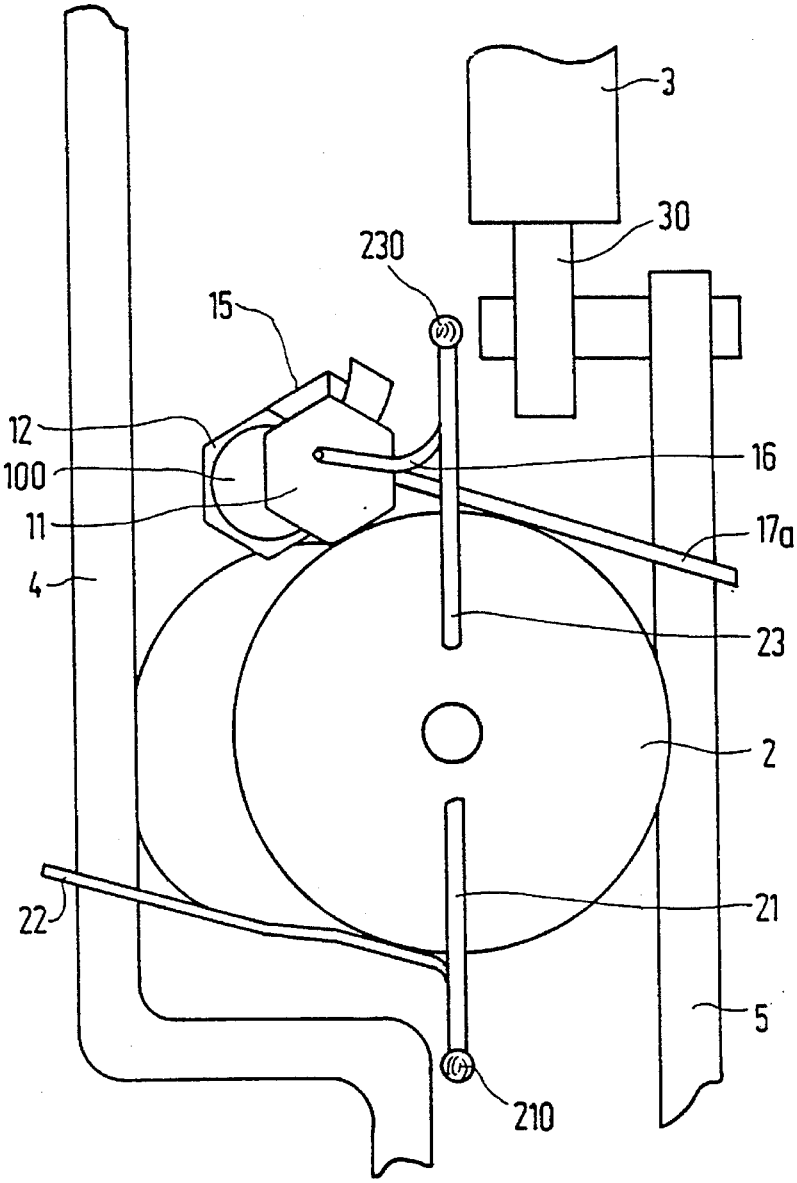
FIG. 4 shows a portion of the lamp of FIG. 2 in which the bimetal switch and glowswitch starter have been assembled together into a separate unit which is positioned between current conductors.

FIG. 3 shows a high-pressure discharge lamp provided with a discharge vessel 3 which is enclosed with intervening space 9 by an outer bulb 8 and is provided with starter unit comprising a bimetal switch t and a glowswitch starter 2.

The discharge vessel has internal main electrodes 300, 700. Each of the main electrodes 300, 700 is connected to a supply conductor 5, 4 by means of a lead-through member 30, 70. The starter unit is mounted between the supply conductors 5, 4 as shown in detail in FIG. 4.

The starter unit is built up as indicated in FIG. 2 and the various parts have been given the same reference numerals.

Glowswitch starter 2 lies between supply conductors 4 and 5 and is fastened thereto by means of conductors 22 and 17*a*. This fastening provides a mechanical mounting and an electrical connection at the same time.

In a practical embodiment of a lamp according to the invention as depicted in the drawing, the rated power is 70 W. The discharge vessel of the lamp has a ceramic wall of densely sintered polycrystalline aluminium oxide and a filling of sodium amalgam and xenon as a buffer gas. Conductors 16 and 17 of the starter unit are formed from Ni—Fe wire with a diameter of 0.6 min. The conductors 17*a* and 22 are formed from Ni wire of 1 mm diameter. Supply conductors are made of Ni wire of 1.5 mm diameter.

le;2qGlowswitch starter 2 is a conventional Philips starter as used in high-pressure sodium lamps of the SON 70W-I type. The ceramic body of the bimetal switch is formed by a ceramic bridge, type MH400, from Dale Electronics. Another possibility is a resistance element from which the resistance windings have been removed. The ceramic body is provided with a nickel cap at either end, each cap being provided with a connection conductor. The bimetal element of the type usual for the SON 70W-I lamp type is welded to one of the connection conductors. The bimetal element then bears on the nickel cap at the other end of the ceramic body in the cold state, acting as a break contact. The starter unit in the practical embodiment has a greatest dimension of 30 mm measured along the longitudinal axis A and a greatest dimension of 17 mm measured in plane V. The ceramic bridge has a length of 16 mm and a diameter of 0.5 mm measured across an end cap. The diameter of the glowswitch starter is 13 mm and its length 30 mm.

le;2qDuring lamp manufacture, the starter unit is assembled in a separate process and built up into a unit as pictured in FIG. 2 of the drawing. Then mounting takes place in that the starter unit thus constructed is placed in the lamp, which was prefabricated in usual manner, and is subsequently welded, upon which the lamp is finished in usual manner.

le;2qIn the lamp production process according to the present state of the art, both mounting of the glowswitch starter and assembly and mounting of the bimetal switch, followed by a test for correct functioning of the bimetal switch and, if necessary, a separate aftertreatment in the form of a readjustment of the bimetal element, take place between conventional prefabrication and conventional finishing of the lamp.

I claim:

1. A high-pressure discharge lamp comprising an outer bulb, a discharge vessel which is enclosed with intervening space by the outer bulb, and a starter circuit comprising a conductor and a bimetal switch with a bimetal element and a break contact, which bimetal element is fastened with a fastening point to the conductor and rests against a break contact point of the break contact of the bimetal switch, characterized in that: (i) the bimetal switch comprises an insulating rigid body having opposing end portions and with an electrical connection conductor at each end portion, (ii) the fastening point and the break contact point form part of said insulating rigid body, and (iii) said insulating rigid body does not enclose said bimetal element, so that said bimetal element is not thermally insulated from heat from said discharge vessel.

2. A lamp as claimed in claim 1, further comprising glow switch starter, characterized in that the bimetal switch and a glow switch starter together form a separate starter unit.

3. A lamp as claimed in claim 2, characterized in that the starter unit is mounted between current supply conductors.

4. A bimetal switch suitable for use in a lamp, said switch comprising: an insulating rigid body having opposing end portions, an electrical connection conductor at each end portion, and a bimetal element, the bimetal element being fastened at one end portion to the respective electrical connection conductor and having a free end adjacent the other end portion's electrical connection conductor for forming a break contact point between said free end and said other electrical connection conductor, and said insulating rigid body does not enclose said bimetal element, so that said bimetal element is not thermally insulated from heat from said discharge vessel.

5. A bimetal switch as claimed in claim 4, characterized in that the insulating rigid body is formed from a ceramic support which is provided with a metal cap at both ends, each cap forming a part of the respective electrical connection conductor.

6. A starter unit suitable for use in a lamp, the starter unit comprising:

(a) a glow switch starter with a longitudinal axis and a housing, and (b) a bimetal switch comprising an insulating rigid body having opposing end portions and a longitudinal axis, an electrical connection conductor at each end and a bimetal element, said bimetal element having an electrically conducting fastening point at one of said electrical connection conductors and having a free end adjacent the other electrical connection conductor forming an electrically conducing break contact point between the bimetal element and said other electrical connection conductor.

7. A starter unit as claimed in claim 6, characterized in that the insulating rigid body is positioned with its long axis parallel to the longitudinal axis and adjacent the housing of the glowswitch starter.

8. A starter unit as claimed in claim 7, characterized in that the starter unit is provided with connection conductors which are situated diametrically opposite one another in relation to the longitudinal axis of the glowswitch starter, tangent to the housing, and parallel to one another in a plane perpendicular to the longitudinal axis of the glowswitch starter.

* * * * *